US005586774A

United States Patent [19]

Dentale

[11] Patent Number: 5,586,774

[45] Date of Patent: Dec. 24, 1996

[54] SPRING SUPPORTED IN-LINE SKATE

[76] Inventor: Patsy Dentale, 2314 E. Third St., Brooklyn, N.Y. 11223

[21] Appl. No.: 528,930

[22] Filed: Sep. 15, 1995

[51] Int. Cl.[6] ..... A63C 17/06

[52] U.S. Cl. ..... 280/11.22; 280/11.28; 280/11.14

[58] Field of Search ..... 280/11.14, 11.15, 280/11.22, 11.27, 11.28

[56] References Cited

U.S. PATENT DOCUMENTS

| | | | |
|---|---|---|---|
| 618,780 | 1/1899 | Bustin | 280/11.14 |
| 829,900 | 8/1906 | Shelmire | 280/11.14 X |
| 893,341 | 7/1908 | Martinsen | 280/11.14 X |
| 2,552,987 | 5/1951 | Loertz, Jr. | 280/11.28 |
| 3,653,678 | 4/1972 | Collett | 280/11.28 X |
| 5,127,672 | 7/1992 | Horibata | 280/11.14 X |
| 5,232,231 | 8/1993 | Carlsmith | 280/11.22 X |
| 5,405,156 | 4/1995 | Gonella | 280/11.22 X |
| 5,492,345 | 2/1996 | Kruczek | 280/11.115 |

*Primary Examiner*—Brian L. Johnson

[57] ABSTRACT

An in-line skate for resiliently supporting a skater relative to a ground surface. The inventive device includes a foot engaging assembly for receiving a human foot. A rolling support assembly is movably mounted to the foot engaging assembly for rollingly engaging a ground surface. A spring assembly is interposed between the foot engaging assembly and the rolling support assembly for resiliently supporting the same in a spaced relationship to absorb bumps and shocks during skating.

7 Claims, 3 Drawing Sheets

10
18
12
20
14
46
2
5
2
50
5
22
26

18

46
44
20
48
50
24

FIG 3
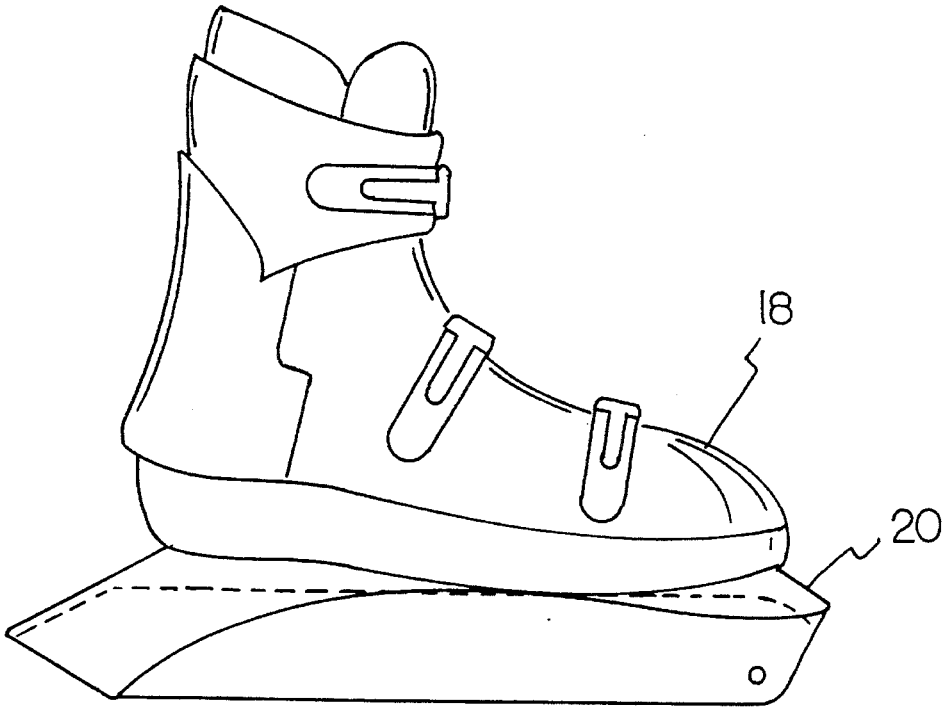
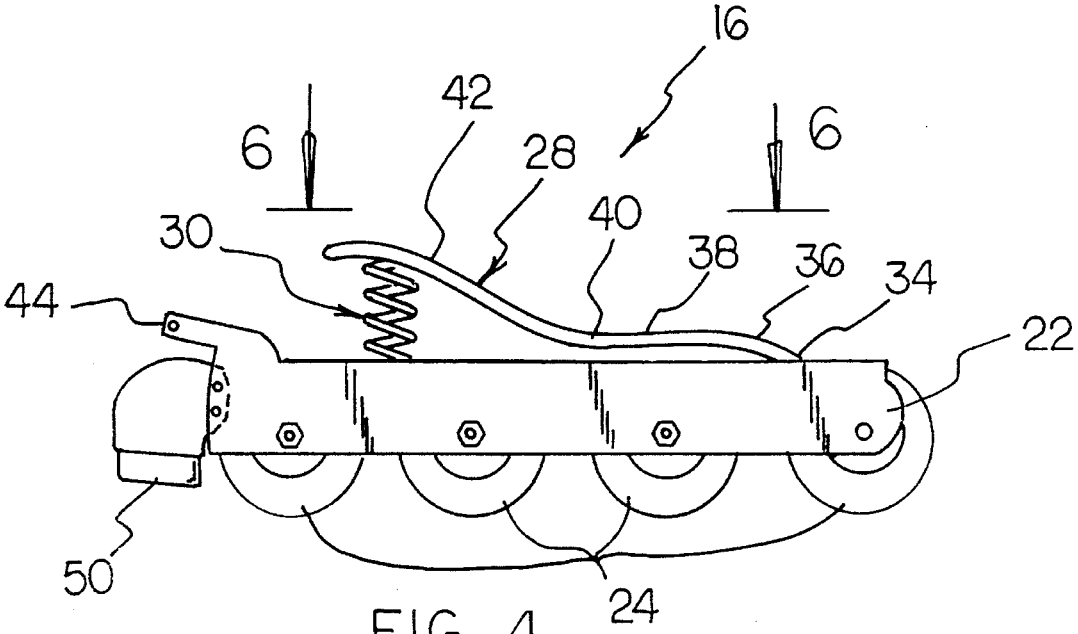
FIG 4

FIG 5
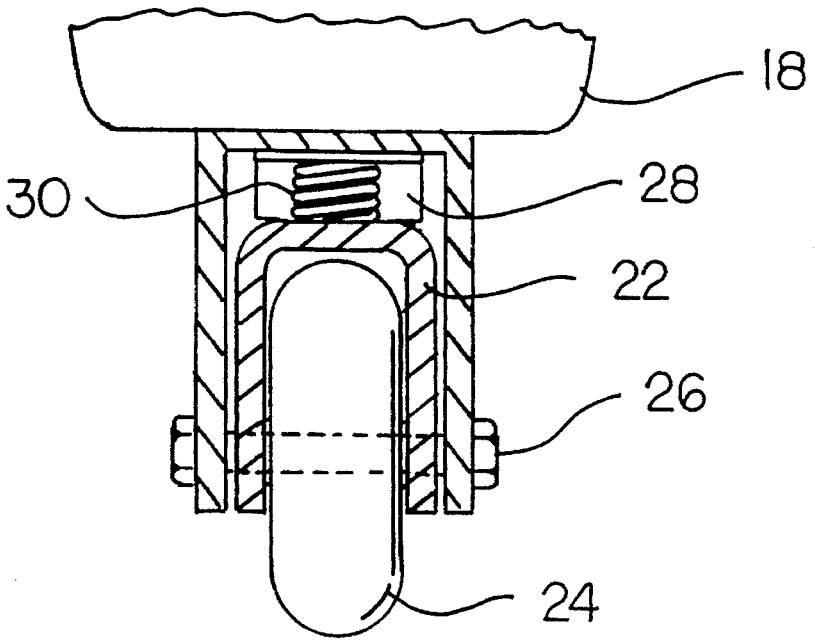
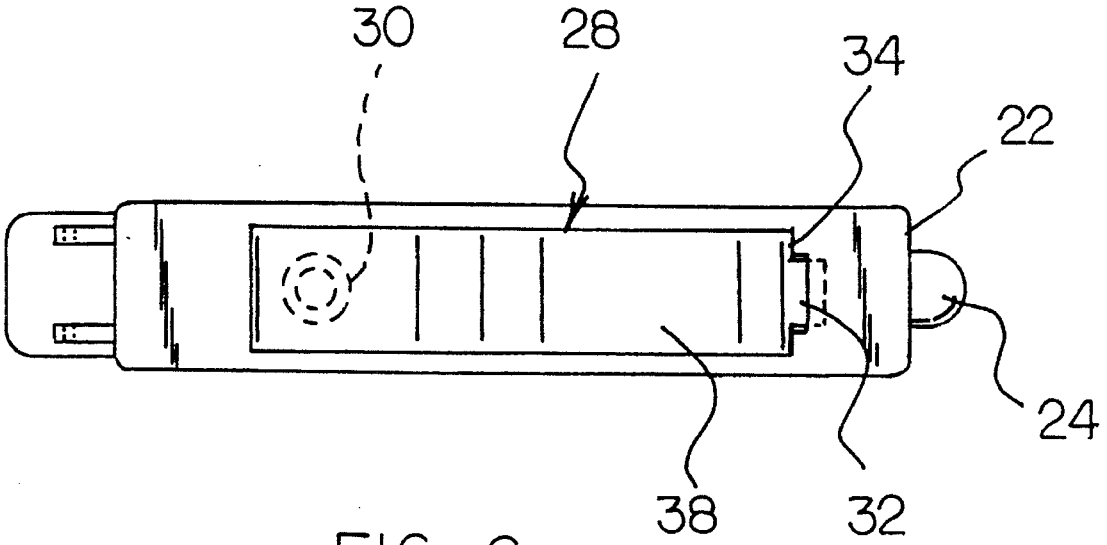
FIG 6

SPRING SUPPORTED IN-LINE SKATE

BACKGROUND OF THE INVENTION

1. Field of the Invention

The present invention relates to roller skate structures and more particularly pertains to a spring supported in-line skate for resiliently supporting a skater relative to a ground surface.

2. Description of the Prior Art

The use of roller skate structures is known in the prior art. More specifically, roller skate structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art roller skate structures include U.S. Pat. No. 4,045,046; U.S. Pat. No. 4,218,098; U.S. Pat. No. 4,915,399; U.S. Pat. No. 5,330,208; and U.S. Pat. No. 5,308,152.

While these devices fulfill their respective, particular objectives and requirements, the aforementioned patents do not disclose a spring supported in-line skate for resiliently supporting a skater relative to a ground surface which includes a foot engaging means for receiving a human foot, a rolling support means movably mounted to the foot engaging means for rollingly engaging a ground surface, and a spring means interposed between the foot engaging means and the rolling support means for resiliently supporting the same in a spaced relationship to absorb bumps and shocks during skating.

In these respects, the spring supported in-line skate according to the present invention substantially departs from the conventional concepts and designs of the prior art, and in so doing provides an apparatus primarily developed for the purpose of resiliently supporting a skater relative to a ground surface.

SUMMARY OF THE INVENTION

In view of the foregoing disadvantages inherent in the known types of roller skate structures now present in the prior art, the present invention provides a new spring supported in-line skate construction wherein the same can be utilized for absorbing bumps and shocks during skating. As such, the general purpose of the present invention, which will be described subsequently in greater detail, is to provide a new spring supported in-line skate apparatus and method which has many of the advantages of the roller skate structures mentioned heretofore and many novel features that result in a spring supported in-line skate which is not anticipated, rendered obvious, suggested, or even implied by any of the prior art roller skate structures, either alone or in any combination thereof.

To attain this, the present invention generally comprises an in-line skate for resiliently supporting a skater relative to a ground surface. The inventive device includes a foot engaging assembly for receiving a human foot. A rolling support assembly is movably mounted to the foot engaging assembly for rollingly engaging a ground surface. A spring assembly is interposed between the foot engaging assembly and the rolling support assembly for resiliently supporting the same in a spaced relationship to absorb bumps and shocks during skating.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new spring supported in-line skate apparatus and method which has many of the advantages of the roller skate structures mentioned heretofore and many novel features that result in a spring supported in-line skate which is not anticipated, rendered obvious, suggested, or even implied by any of the prior art roller skate structures, either alone or in any combination thereof.

It is another object of the present invention to provide a new spring supported in-line skate which may be easily and efficiently manufactured and marketed.

It is a further object of the present invention to provide a new spring supported in-line skate which is of a durable and reliable construction.

An even further object of the present invention is to provide a new spring supported in-line skate which is susceptible of a low cost of manufacture with regard to both materials and labor, and which accordingly is then susceptible of low prices of sale to the consuming public, thereby making such spring supported in-line skates economically available to the buying public.

Still yet another object of the present invention is to provide a new spring supported in-line skate which provides in the apparatuses and methods of the prior art some of the advantages thereof, while simultaneously overcoming some of the disadvantages normally associated therewith.

Still another object of the present invention is to provide a new spring supported in-line skate for resiliently supporting a skater relative to a ground surface.

Yet another object of the present invention is to provide a new spring supported in-line skate which includes a foot engaging means for receiving a human foot, a rolling support means movably mounted to the foot engaging means for rollingly engaging a ground surface, and a spring means interposed between the foot engaging means and the rolling support means for resiliently supporting the same in a spaced relationship to absorb bumps and shocks during skating.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an elevation view of a foot engaging means comprising a portion of the present invention.

FIG. 4 is an elevation view of a rolling support means comprising a further portion of the present invention.

FIG. 5 is a cross-sectional view taken along line 5—5 of FIG. 1.

FIG. 6 is a top plan view of the rolling support means taken from line 6—6 of FIG. 4.

DESCRIPTION OF THE PREFERRED EMBODIMENT

Figure 1:
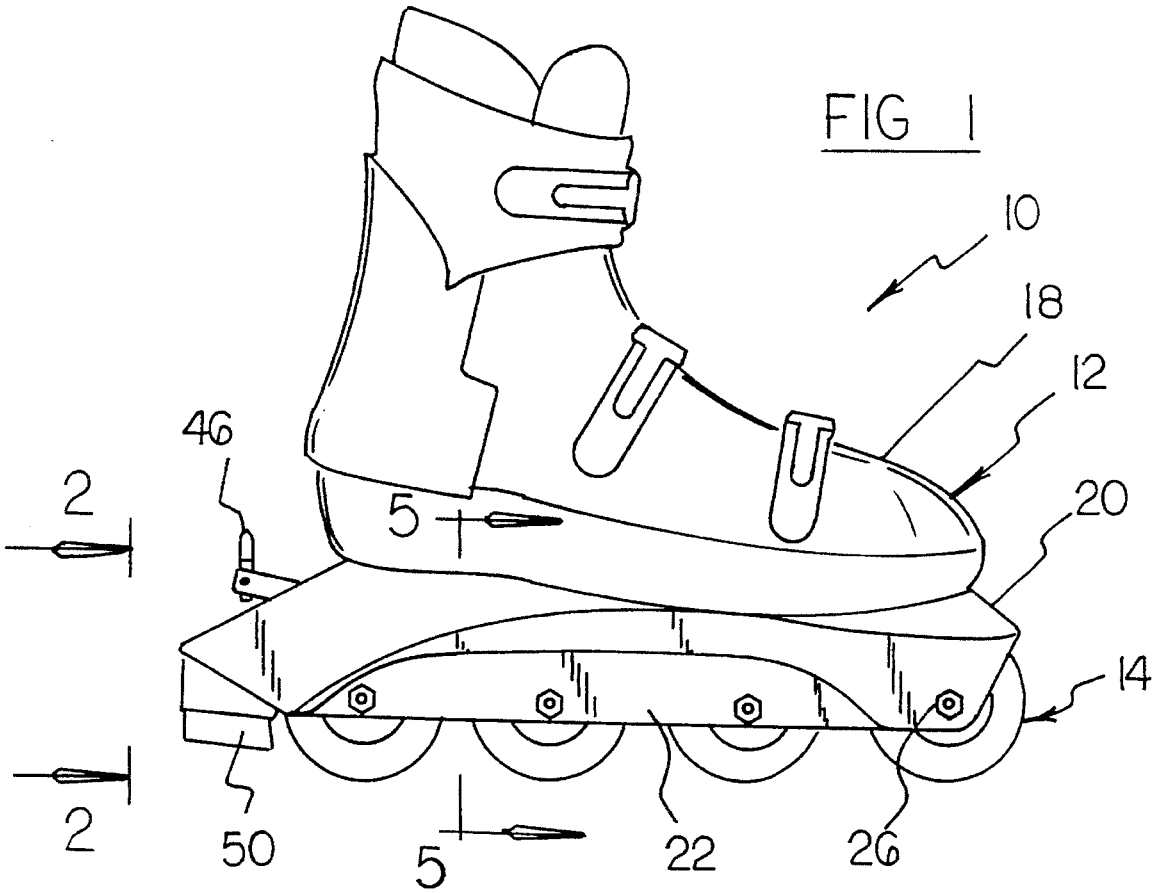
FIG. 1 is an elevation view of a spring supported in-line skate according to the present invention.

With reference now to the drawings, and in particular to FIGS. 1–6 thereof, a new spring supported in-line skate embodying .the principles and concepts of the present invention and generally designated by the reference numeral 10 will be described.

More specifically, it will be noted that the spring supported in-line skate 10 comprises a foot engaging means 12 for receiving and engaging a foot of an individual during use of the device 10. A rolling support means 14 is movably mounted relative to the foot engaging means 12 for rollingly engaging a ground surface therebeneath. A spring means 16 (see FIG. 4) is interposed between the foot engaging means 12 and the rolling support means 14 for resiliently supporting the foot engaging means 12 relative to the rolling support means 14 so as to absorb bumps and shocks during skating. By this structure, the rolling support means 14 is permitted to resiliently articulate relative to the foot engaging means 12 such that a skater encountering bumps or otherwise rough topography upon an associated ground surface will be resiliently supported relative thereto.

Figure 2:
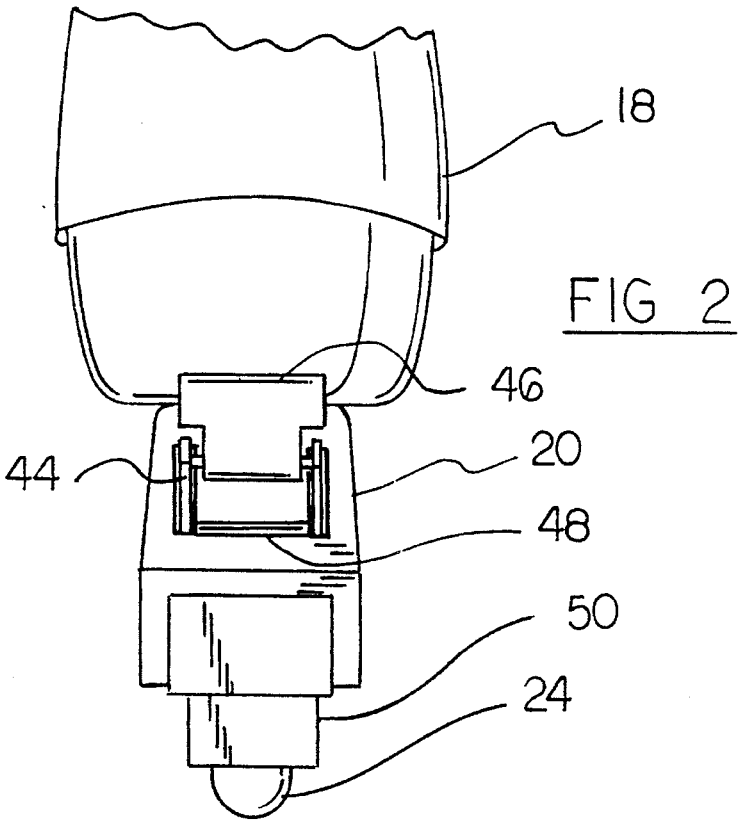
FIG. 2 is a rear elevation view of a portion of the present invention taken from line 2—2 of FIG. 1.

As best illustrated in FIGS. 1 through 3, it can be shown that the foot engaging means 12 of the present invention 10 preferably comprises a boot 18 adapted to receive and engage a human foot therewithin. An outer receiver 20 of elongated configuration is secured to a lower portion of the boot 18 and receives the rolling support means 14 at least partially therewithin.

Referring now to FIGS. 4 through 6 with concurrent reference to FIGS. 1 through 3, it can be shown that the rolling support means 14 of the present invention 10 preferably comprises an inner wheel rack 22 of elongated configuration which rotatably supports a plurality of wheels 24 in an in-line configuration wherein the wheels 24 all reside and rotate within a common plane. The inner wheel rack 22 is pivotally mounted to the forward end of the outer receiver 20 by a pivot pin 26 directed therethrough. The pivot pin 26 comprises an axle rotatably supporting a forwardmost one of the wheels 24. By this structure, the rolling support means 14 is pivotally supported relative to the foot engaging means 12.

As best illustrated in FIGS. 4 through 6, it can be shown that the spring means 16 of the present invention 10 resiliently supporting the rolling support means 14 of the foot engaging means 12 preferably comprises either a leaf spring 28 or a coil spring 30 interposed therebetween. The leaf spring 28, as shown in FIG. 4, preferably includes a mounting tab 32 projecting from a first end 34 of the leaf spring 28 which is received within an unlabelled and correspondingly shaped aperture directed through the inner wheel rack 22 so as to mount the leaf spring 28 in a cantilevered orientation relative to the inner wheel rack. The leaf spring 28 extends from the first end 34 through a first integral bend 36 into a parallel portion 38 which is oriented in a substantially spaced and parallel orientation relative to an upper planar surface of the inner wheel rack 22. The leaf spring 28 continues from the parallel portion 38 through a second integral bend 40 into an angled portion 42 projecting from the parallel portion 38 at an oblique angle relative thereto. The angled portion 42 engages an interior surface of the outer receiver 20 so as to effect flexing of the cantilevered leaf spring 28 during articulation of the inner wheel rack 22 within the outer receiver. By this structure, the leaf spring 28 provides a variable amount of spring force support relative to a pivotal positioning of the inner wheel rack 22 within the outer receiver 20. In this respect, the leaf spring 28 is initially engaged to the inner wheel rack 22 at only the first end 34 thereof. However, as the leaf spring 28 is bent towards the inner wheel rack 22, the second integral bend 40 between the parallel portion 38 and the angled portion 42 will engage an upper surface of the inner wheel rack 22, thereby decreasing a moment arm of the leaf spring 28 as defined between a point of contact of the second integral bend 40 with the upper surface of the inner wheel rack 22 at a point of contact of the angled portion 42 which the interior surface of the outer receiver 20. As such, the leaf spring 28 will subsequently exert a greater supporting force against pivoting of the inner wheel rack 22 into the outer receiver 20.

With continuing reference to FIGS. 4 and 5, it can be shown that the spring means 16, in lieu of or in addition to the leaf spring 28, may comprise the coil spring 30 simply interposed between the inner wheel rack 22 and the interior of the outer receiver 20. Alternatively, the coil spring 30 may be interposed between the inner wheel rack 22 and the angled portion 42 of the leaf spring 28 as shown in the drawings so as to further support the leaf spring 28.

As best illustrated in FIGS. 1, 2, and 4, it can be shown that the outer receiver 20 may be shaped so as to define at least one slot directed therethrough permitting extension of a rear projection 44 of the inner wheel rack 22 therethrough. A locking member 46 is pivotally mounted to the rear projection 44 and can be frictionally retained relative thereto in a desired position. The locking member 46 can be positioned into a groove 48 formed in the exterior surface of the outer receiver 20, as shown in FIG. 2, so as to position the inner wheel rack 22 in a desired orientation relative to the outer receiver 20. In other words, the spring means 16 can be fully compressed, with the locking member 46 being engaged to the groove 48 so as to retain the inner wheel rack 22 in a fixed orientation relative to the outer receiver 20. Also shown in FIGS. 1 and 2 is a brake pad 50 extending from a rear end of the inner wheel rack 22 for engagement against a ground surface in a conventionally known manner so as to effect deceleration of the associated skate 10.

In use, the spring supported in-line skate 10 of the present invention can be easily utilized for resiliently supporting a skater relative to a ground surface. The rolling support means 14 is thus permitted to resiliently articulate relative to the foot engaging means 12 so as to absorb shocks and bumps encountered along a ground surface during skating.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A spring supported in-line skate comprising:

a foot engaging means comprising a boot adapted to receive and engage a human foot therewithin and an inverted, U-shaped outer receiver secured directly to a lower portion of the boot a rolling support means secured to said outer receiver and movable relative to the foot engaging means for rollingly engaging a ground surface therebeneath, said rolling support means comprising an inner wheel rack of elongated configuration; a plurality of wheels rotatably supported in an in-line configuration within the inner wheel rack; the inner wheel rack being pivotally mounted to a forward end of the outer receiver by a pivot pin directed therethrough wherein the pivot pin comprises an axle rotatably supporting a forwardmost one of the wheels;

and, a spring means interposed between the foot engaging means and the rolling support means for resiliently supporting the foot engaging means relative to the rolling support means.

2. The spring supported in-line skate of claim 1, wherein the spring means comprises a leaf spring interposed between the outer receiver of the foot engaging means and the inner wheel rack of the rolling support means.

3. The spring supported in-line skate of claim 2, wherein the leaf spring includes a mounting tab projecting from a first end of the leaf spring which is received within a correspondingly shaped aperture directed through the inner wheel rack so as to mount the leaf spring in a cantilevered orientation relative to the inner wheel rack, the leaf spring extending from the first end thereof through a first integral bend and into a parallel portion which is oriented in a substantially spaced orientation relative to an upper planar surface of the inner wheel rack, the leaf spring continuing from the parallel portion through a second integral bend into an angled portion projecting from the parallel portion at an oblique angle relative thereto, the angled portion engaging an interior surface of the outer receiver so as to effect flexing of the cantilevered leaf spring during articulation of the inner wheel rack within the outer receiver.

4. The spring supported in-line skate of claim 3, wherein the spring means further comprises a coil spring interposed between the inner wheel rack and the angled portion of said leaf spring.

5. The spring supported in-line skate of claim 4, wherein the outer receiver is shaped so as to define at least one slot directed therethrough; and further wherein the inner wheel rack includes a rear projection extending through the slot of the outer receiver; and further comprising a locking member pivotally mounted to the rear projection, the locking member being positionable into a contact with an exterior surface of the outer receiver so as to position the inner wheel rack in a predetermined orientation relative to the outer receiver.

6. The spring supported in-line skate of claim 1, wherein the spring means comprises a coil spring interposed between the inner wheel rack and an interior of the outer receiver.

7. The spring supported in-line skate of claim 6, wherein the outer receiver is shaped so as to define at least one slot directed therethrough; and further wherein the inner wheel rack includes a rear projection extending through the slot of the outer receiver; and further comprising a locking member pivotally mounted to the rear projection, the locking member being positionable into a contact with an exterior surface of the outer receiver so as to position the inner wheel rack in a predetermined orientation relative to the outer receiver.

* * * * *